US008725029B2

(12) United States Patent
Fukuhara

(10) Patent No.: US 8,725,029 B2
(45) Date of Patent: May 13, 2014

(54) IMAGE FORMING APPARATUS AND BELT TRANSPORT DEVICE HAVING A CLEANING MECHANISM

(75) Inventor: Taku Fukuhara, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 329 days.

(21) Appl. No.: 13/008,404

(22) Filed: Jan. 18, 2011

(65) Prior Publication Data

US 2012/0051779 A1 Mar. 1, 2012

(30) Foreign Application Priority Data

Aug. 31, 2010 (JP) ..... 2010-194034

(51) Int. Cl.
*G03G 15/16* (2006.01)

(52) U.S. Cl.
USPC ..... 399/101

(58) Field of Classification Search
USPC ..... 399/101, 99, 303, 312, 313
See application file for complete search history.

(56) References Cited

U.S. PATENT DOCUMENTS

| | | | | |
|---|---|---|---|---|
| 5,579,096 | A * | 11/1996 | Saito et al. | 399/101 |
| 6,070,043 | A | 5/2000 | Fujita et al. | |
| 6,175,711 | B1 * | 1/2001 | Yoshino et al. | 399/313 |
| 6,970,666 | B2 * | 11/2005 | Takahashi et al. | 399/101 |
| 7,242,894 | B2 * | 7/2007 | Kuo et al. | 399/313 |
| 7,343,126 | B2 * | 3/2008 | Miyawaki et al. | 399/312 |
| 7,376,375 | B2 * | 5/2008 | Kobayashi et al. | 399/312 |
| 7,869,736 | B2 * | 1/2011 | Inoue | 399/101 |
| 7,937,016 | B2 * | 5/2011 | Kamijo et al. | 399/101 |
| 2002/0085864 | A1 * | 7/2002 | Abe | |
| 2003/0112316 | A1 * | 6/2003 | Aruga et al. | |
| 2007/0196124 | A1 * | 8/2007 | Thayer | 399/101 |
| 2008/0298843 | A1 * | 12/2008 | Hobo et al. | |
| 2008/0317495 | A1 * | 12/2008 | Hyakutake et al. | 399/101 |
| 2009/0087232 | A1 * | 4/2009 | Torimaru | 399/313 |

FOREIGN PATENT DOCUMENTS

| | | | |
|---|---|---|---|
| JP | A-6-59586 | | 3/1994 |
| JP | A-10-260587 | | 9/1998 |
| JP | 2005315987 | A * | 11/2005 |
| JP | A-2005-315987 | | 11/2005 |
| JP | A-2005-316102 | | 11/2005 |
| JP | A-2006-163097 | | 6/2006 |
| JP | A-2009-139752 | | 6/2009 |

OTHER PUBLICATIONS

Notification of Reasons for Refusal dated Mar. 18, 2014 from Japanese Patent Application No. 2010-194034 (English-language translation only).

* cited by examiner

*Primary Examiner* — Susan Lee
(74) *Attorney, Agent, or Firm* — Oliff PLC

(57) ABSTRACT

An image forming apparatus includes: an image forming unit forming a toner image; an image carrier carrying the toner image; an endless transfer belt rotating with a recording medium interposed between the transfer belt and the image carrier; a cleaner provided in contact with an outer surface of the transfer belt and electrostatically cleaning toner on the outer surface; a transfer roll provided inside the transfer belt and generating a transfer electric field for transferring the toner image from the image carrier to the recording medium while pressing the transfer belt toward the image carrier; a cleaning roll mounted around by the transfer belt as well as the transfer roll, the cleaning roll provided to face the cleaner and generating a cleaning electric field; and a tension roll mounted around by the transfer belt as well as the transfer roll and the cleaning roll.

10 Claims, 5 Drawing Sheets

IMAGE FORMING APPARATUS AND BELT TRANSPORT DEVICE HAVING A CLEANING MECHANISM

CROSS REFERENCE TO RELATED APPLICATIONS

This application is based on and claims priority under 35 USC §119 from Japanese Patent Application No. 2010-194034 filed Aug. 31, 2010.

BACKGROUND

1. Technical Field

The present invention relates to an image forming apparatus and a belt transport device.

2. Related Art

An image forming apparatus including a transfer device and a cleaner for cleaning the transfer device has been widely used.

SUMMARY

According to an aspect of the present invention, there is provided an image forming apparatus including: an image forming unit that forms a toner image; an image carrier that carries the toner image formed by the image forming unit; a transfer belt that is endless and rotates with a recording medium interposed between the transfer belt and the image carrier; a cleaner that is provided to be in contact with an outer surface of the transfer belt and electrostatically cleans toner adhering to the outer surface of the transfer belt; a transfer roll that is provided inside the transfer belt and generates a transfer electric field between the transfer roll and the image carrier for transferring the toner image from the image carrier to the recording medium while pressing the transfer belt toward the image carrier; a cleaning roll which is mounted around by the transfer belt as well as the transfer roll, the cleaning roll being provided to face the cleaner and generating a cleaning electric field between the cleaning roll and the cleaner; and a tension roll which is mounted around by the transfer belt as well as the transfer roll and the cleaning roll.

BRIEF DESCRIPTION OF THE DRAWINGS

An exemplary embodiment of the present invention will be described in detail based on the following figures, wherein.

DETAILED DESCRIPTION

Hereinafter, the exemplary embodiment of the present invention is described in detail with reference to the accompanying drawings.

Figure 1:
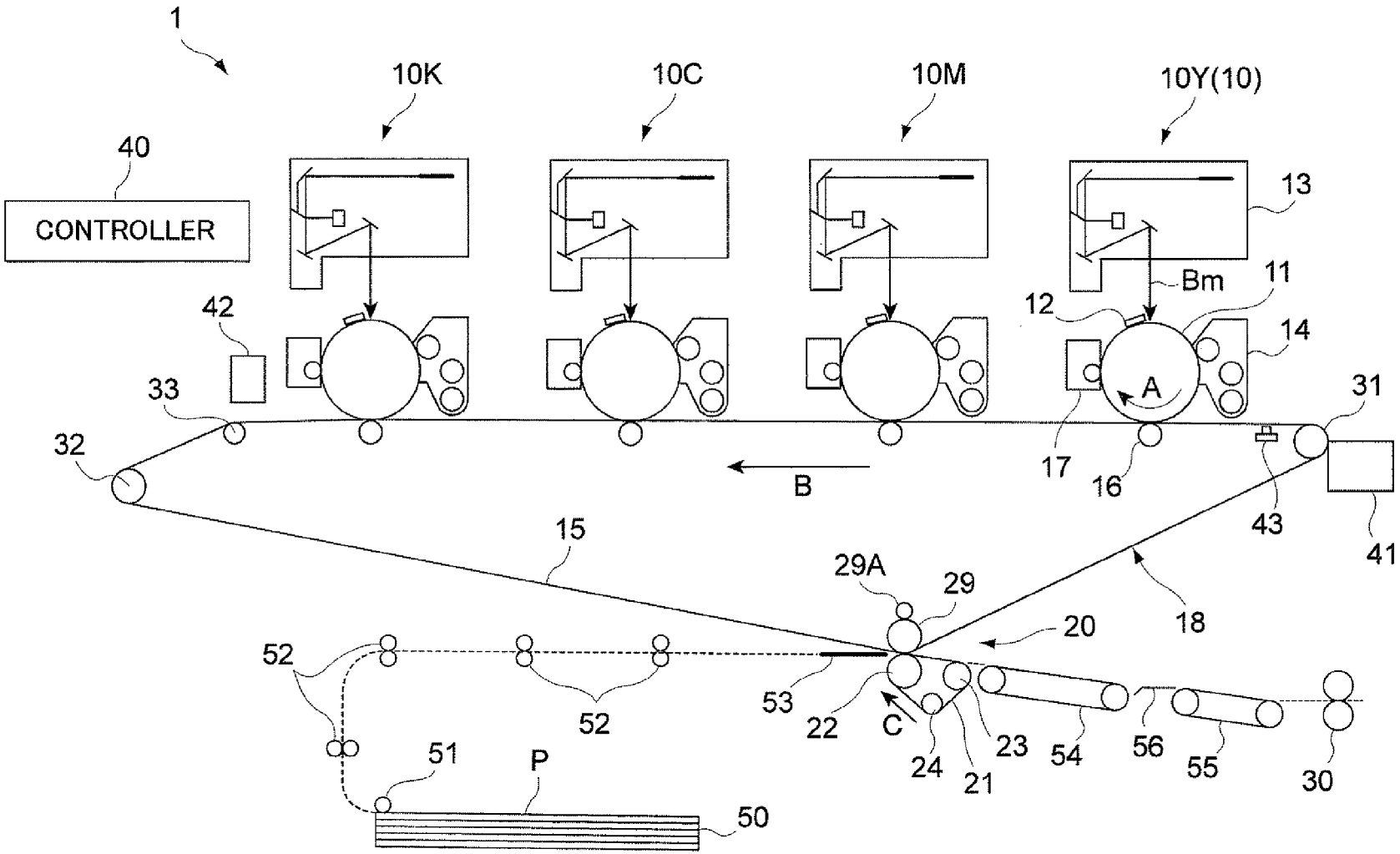
FIG. 1 is an overall view of an image forming apparatus to which the exemplary embodiment is applied.

FIG. 1 is the overall view of an image forming apparatus 1 to which the exemplary embodiment is applied.

The image forming apparatus 1 is a so-called tandem-type image forming apparatus and includes plural image forming units 10 (10Y, 10M, 10C, 10K) in which toner images of respective color components are formed by an electrophotographic system and an intermediate transfer belt 15 onto which the toner images of respective color components having been formed by the respective image forming units 10 are successively transferred (primary transfer) to be carried thereon. The image forming apparatus 10 also includes a secondary transfer device 20 that collectively transfers (secondary transfer) the superimposed images having been transferred to the intermediate transfer belt 15 onto a sheet P and a fixing device 30 that fixes the secondarily transferred image on the sheet P as an example of a recording medium. The image forming apparatus 1 further includes a controller 40 that controls operations in each unit or device.

In the exemplary embodiment, each image forming unit 10 (10Y, 10M, 10C, 10K) includes a photoconductive drum 11 that rotates in the direction of an arrow A, a charging device 12 that is provided around the photoconductive drum 11 and charges the photoconductive drum 11 and a laser exposure unit 13 (an exposure beam is indicated by a sign Bm in the figure) that writes an electrostatic latent image on the photoconductive drum 11. The image forming unit 10 also includes a developing device 14 that contains toner of each color component and visualizes the electrostatic latent image on the photoconductive drum 11 with the toner and a primary transfer roll 16 that transfers the toner image of each color component formed on the photoconductive drum 11 onto the intermediate transfer belt 15. The image forming unit 10 further includes a drum cleaner 17 that removes residual toner on the photoconductive drum 11. These image forming units 10 are arranged in the order of yellow (Y), magenta (M), cyan (C) and black (K) from the upstream side of the intermediate transfer belt 15.

As the intermediate transfer belt 15 as an image carrier, a resin such as polyimide or polyamide containing a conductive agent such as carbon black or the like of an appropriate amount is employed, and the intermediate transfer belt 15 is formed to have a volume resistivity of about $10^6$ to about $10^{14}$ Ω·cm, which is configured with a film-like endless belt having a thickness of, for example, about 0.1 mm. The intermediate transfer belt 15 is mounted around a drive roll 31 that is driven by a motor not shown in the figure to drive and rotate the intermediate transfer belt 15, a tension roll 32 that provides a constant tension to the intermediate transfer belt 15 while having a function to prevent belt walk of the intermediate transfer belt 15, a follower roll 33 that supports the intermediate transfer roll 15 and a backup roll 29 that forms a secondary transfer portion that will be described later. The intermediate transfer belt 15 rotates in the direction of an arrow B in the figure at a predetermined speed.

Each primary transfer roll 16 faces the image forming unit 10 of each color with the intermediate transfer belt 15 interposed therebetween. A voltage of a polarity opposite to that of the charging polarity of the toner is applied to each primary transfer roll 16. Each primary transfer roll 16 electrostatically attracts the toner image on each photoconductive drum 11 to the intermediate transfer belt 15. As a result, superimposed toner images containing respective colors are formed on the intermediate transfer belt 15.

The secondary transfer device 20 includes: a secondary transfer belt 21 that holds the sheet P between the secondary transfer belt 21 itself and the intermediate transfer belt 15 and rotates in the direction of an arrow C; a secondary transfer roll 22 that transfers the toner image carried on the intermediate transfer belt 15 onto the sheet P; a peeling roll 23 that peels off the sheet P moving along with the secondary transfer belt 21 from the secondary transfer belt 21 and a cleaner-facing roll 24 that faces a cleaning device 90 (refer to FIG. 2 described later) electrostatically cleaning the surface of the secondary transfer roll 21. As described above, in the secondary transfer device 20 of the exemplary embodiment, a so-called belt transfer system is employed, in which the toner image formed on the intermediate transfer belt 15 is transferred onto the sheet P by use of the secondary transfer belt 21.

Further, as shown in FIG. 1, a belt cleaner 41 that removes residual toner or paper debris on the intermediate transfer belt 15 after the secondary transfer is provided downstream of the backup roll 29 to clean the surface of the intermediate transfer belt 15, the belt cleaner 41 being provided to be contactable with and separable from the intermediate transfer belt 15. On the other hand, on the upstream side of the yellow image forming unit 10Y, a reference sensor (home position sensor) 43 that generates a reference signal as a basis for determining the timing of image formation in each image forming unit 10 is disposed. The reference sensor 43 recognizes a predetermined mark provided on the backside of the intermediate transfer belt 15 and generates the reference signal, and each image forming unit 10 is configured to start image formation upon receiving instructions from the controller 40 based on recognition of the reference signal. On the downstream side of the black image forming unit 10K, an image density sensor 42 is provided to perform image quality adjustment on the image formed by each image forming unit 10.

Further, as a sheet transport system, the image forming apparatus 1 is provided with a sheet container 50 that contains sheets P and a pickup roll 51 that takes out the sheets P collected and piled in the sheet container 50 at a predetermined timing. The image forming apparatus 1 also includes transport rolls 52 that transport the sheets P taken out by the pickup roll 51 and a transport route 53 that forwards the sheets P transported by the transport rolls 52 to the secondary transfer portion configured with the secondary transfer device 20. The image forming apparatus 1 further includes transport belts 54 and 55 that transport the sheet P after the secondary transfer to the fixing device 30 and a guide route 56 provided between the transport belts 54 and 55 for guiding the sheet P.

Figure 2:
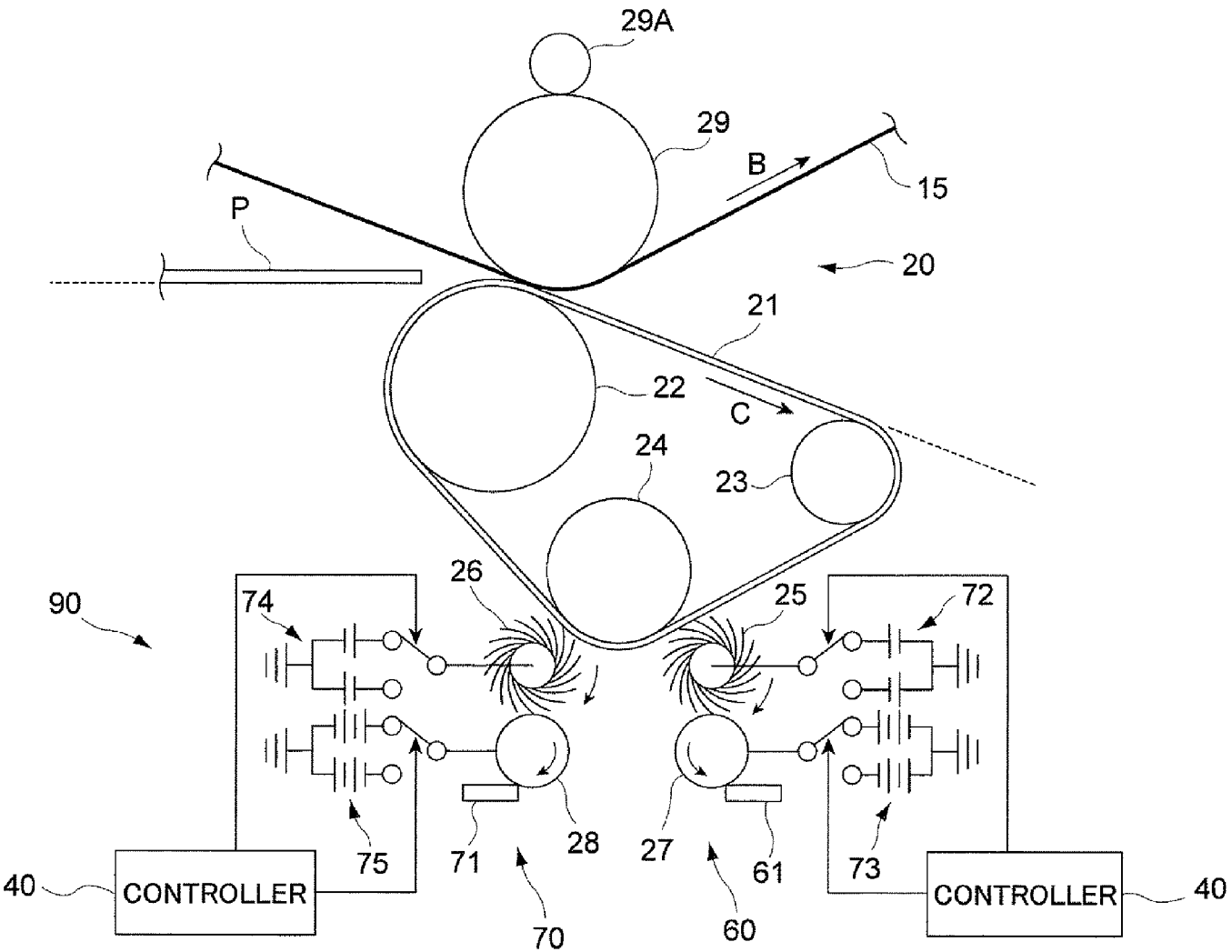
FIG. 2 is an overall view of a secondary transfer device to which the exemplary embodiment is applied.

FIG. 2 is the overall view of the secondary transfer device 20 to which the exemplary embodiment is applied.

As shown in FIG. 2, the secondary transfer device 20 includes the backup roll 29 that faces the secondary transfer roll 22 with the secondary transfer belt 21 interposed therebetween. The backup roll 29 is a tube of rubber made by blending EPDM and NBR, on the surface of which carbon is dispersed, inside thereof is formed of EPDM rubber, the surface resistivity thereof is about $10^7$ to about $10^{10}\Omega/\square$, the backup roll 29 is formed to have a diameter of about 28 mm, and the hardness thereof is set to, for example, about 70 points (ASKER C). The backup roll 29 is arranged on the back surface of the intermediate transfer belt 15 to serve as a counter electrode of the secondary transfer belt 21. The backup roll 29 is provided with a power feeding roll 29A made of stainless steel, which is in contact with the backup roll 29, to apply a voltage for generating a secondary transfer electric field (hereinafter, referred to as a secondary transfer voltage) at the secondary transfer portion.

The secondary transfer belt 21 as an example of a transfer belt is a semiconductive endless loop belt having a volume resistance of, for example, about $10^6$ to about $10^{10}\Omega$ (about 6 to about 10 log Ω). As shown in FIG. 2, the secondary transfer belt 21 is mounted around the secondary transfer roll 22, the peeling roll 23 and the cleaner-facing roll 24. Further, the secondary transfer belt 21 is provided with a predetermined tension by the secondary transfer roll 22, the peeling roll 23 and the cleaner-facing roll 24. In the exemplary embodiment, the secondary transfer belt 21 receives a driving force from the secondary transfer roll 22, thereby rotating in the direction of the arrow C in the figure at a predetermined speed.

The secondary transfer roll 22 as an example of a transfer roll is arranged to face the backup roll 29 with the secondary transfer belt 21 and the intermediate transfer belt 15 interposed therebetween. With the backup roll 29, the secondary transfer roll 22 forms the secondary transfer portion that performs secondary transfer of the toner image carried by the intermediate transfer belt 15 onto the sheet P transported on the secondary transfer belt 21. The secondary transfer roll 22 generates the secondary transfer electric field between the secondary transfer roll 22 itself and the backup roll 29 of the intermediate transfer belt 15.

Moreover, a drive motor not shown in the figure is connected to the secondary transfer roll 22 in the exemplary embodiment. The secondary transfer roll 22 receives a rotational driving force from the drive motor and rotates, and further rotates the secondary transfer belt 21.

In the exemplary embodiment, the volume resistance of the secondary transfer roll 22 is set within a range of about $10^6$ to about $10^{10}\Omega$ (about 6 to about 10 log Ω). In the exemplary embodiment, semiconductive rubber is used as a material of the secondary transfer roll 22. As the semiconductive rubber, for example, foamed rubber containing EPDM and further containing appropriate amount of carbon black may be used. Further, in the exemplary embodiment, the volume resistance of the secondary transfer roll 22 is set to about $10^{7.2}\Omega$ (about 7.2 log Ω), thus generating an electric field of adequate strength at the secondary transfer portion to improve the transfer performance.

The peeling roll 23 as an example of a tension roll is, as shown in FIG. 2, positioned downstream of the secondary transfer roll 22 in the rotation direction of the secondary transfer belt 21 (direction of the arrow C in the figure). In the secondary transfer device 20 in the exemplary embodiment, a belt surface between the peeling roll 23 and the secondary transfer roll 22 transports the sheet P toward the downstream side in the moving direction of the belt surface. The peeling roll 23 peels off the sheet P from the surface of the secondary transfer belt 21. The peeling roll 23 of the exemplary embodiment provides a curvature, such that a thin sheet, coated sheet or the like may be peeled off from the secondary transfer belt 21, to the secondary transfer belt 21. In the exemplary embodiment, for providing the above-described curvature to the secondary transfer belt 21, the diameter of the peeling roll 23 is set to equal to or less than half of the diameter of the secondary transfer roll 22.

The cleaner-facing roll 24 as an example of a cleaning roll faces the cleaning device 90 with the secondary transfer belt 21 interposed therebetween. With the cleaning device 90, the cleaner-facing roll 24 generates a cleaning electric field to electrostatically reclaim toner adhered to the secondary transfer belt 21 or the like. In the exemplary embodiment, the volume resistance of the cleaner-facing roll 24 is set to less than about $10^6\Omega$ (about 6 log Ω). Further, in the exemplary embodiment, metal such as SUS may be used as a material of the cleaner-facing roll 24, for example.

In the exemplary embodiment, a metal roll member whose volume resistance is set to about $10^{5.5}\Omega$ (about 5.5 log Ω) is used as the cleaner-facing roll 24. In the exemplary embodiment, increase of the volume resistance over time caused by voltage application is suppressed by use of the metal roll as the cleaner-facing roll 24.

The cleaning device 90 as an example of a cleaner is provided to face the cleaner-facing roll 24 with the secondary transfer belt 21 interposed therebetween. The cleaning device 90 generates the cleaning electric field between the cleaning device 90 itself and the cleaner-facing roll 24 to electrostatically attract toner adhered to the surface of the secondary transfer belt 21 or the like. The cleaning device 90 of the exemplary embodiment includes a first cleaning portion 60 that applies a predetermined voltage to the cleaner-facing roll 24 and a second cleaning portion 70 that applies a voltage having a polarity opposite to that of the first cleaning portion 60 to the cleaner-facing roll 24. The cleaning device 90 electrostatically attracts toner adhered to the surface of the secondary transfer belt 21 by the first cleaning portion 60 and the second cleaning portion 70. In the description below, a voltage generating the cleaning electric field in the cleaning device 90 is referred to as a cleaning voltage.

The first cleaning portion 60 includes a first fur brush 25 having conductivity that is brought into contact with the secondary transfer belt 21 to collect foreign material such as toner on the secondary transfer belt 21, a first reclaim roll 27 that is provided adjacent to the first fur brush 25 and reclaims the foreign material from the first fur brush 25 and a first scraper 61 that is brought into contact with the first reclaim roll 27 and scrapes the foreign material from the first reclaim roll 27.

The second cleaning portion 70 includes a second fur brush 26 having conductivity that is brought into contact with the secondary transfer belt 21 to collect foreign material such as toner on the secondary transfer belt 21, a second reclaim roll 28 that is provided adjacent to the second fur brush 26 and reclaims the foreign material from the second fur brush 26, and a second scraper 71 that is brought into contact with the second reclaim roll 28 and scrapes the foreign material from the second reclaim roll 28.

The first fur brush 25 as an example of a first cleaning member and the second fur brush 26 as an example of a second cleaning member may be configured with, for example, conductive nylon. The outer diameter of each of the first fur brush 25 and the second fur brush 26 may be, for example, about 17 mm. The volume resistivity of the first fur brush 25 and the second fur brush 26 is set within the range from about $10^5$ to about $10^6$ Ω·cm. The first fur brush 25 and the second fur brush 26 are arranged in contact with the secondary transfer belt 21 to remove toner adhered to the secondary transfer belt 21.

The first reclaim roll 27 and the second reclaim roll 28 are configured with, for example, a conductive phenolic resin and the diameters of these rolls are set to about 16 mm. The volume resistivity of the first reclaim roll 27 and the second reclaim roll 28 is set within the range from about $10^7$ to about $10^9$ Ω·cm. The first reclaim roll 27 and the second reclaim roll 28 are arranged adjacent to the first fur brush 25 and the second fur brush 26, respectively. The first reclaim roll 27 and the second reclaim roll 28 reclaim the toner removed by the first fur brush 25 and the second fur brush 26, respectively.

As each of the first scraper 61 and the second scraper 71 of the exemplary embodiment, for example, a stainless steel plate is employed. The first scraper 61 and the second scraper 71 are brought into contact with the first reclaim roll 27 and the second reclaim roll 28, respectively, in a direction opposing to the rotation direction of each roll. The first scraper 61 and the second scraper 71 scrape off the foreign material adhered to the first reclaim roll 27 and the second reclaim roll 28, respectively.

Further, as shown in FIG. 2, in the secondary transfer device 20 of the exemplary embodiment, the first cleaning portion 60 is arranged in contact with the belt surface between the cleaner-facing roll 24 and the peeling roll 23. Moreover, in the secondary transfer device 20, the second cleaning portion 70 is arranged in contact with the belt surface between the cleaner-facing roll 24 and the secondary transfer roll 22. As described above, in the exemplary embodiment, the first cleaning portion 60 and the second cleaning portion 70 are arranged on the different belt surfaces of the secondary transfer belt 21. In the secondary transfer device 20 of the exemplary embodiment, electrical interference between the first cleaning portion 60 and the second cleaning portion 70 is sought to be suppressed.

In the cleaning device 90 configured as described above, voltages of mutually different polarities are applied to the first cleaning portion 60 and the second cleaning portion 70. In other words, there is a possibility that toner particles or pieces of paper debris remaining on the secondary transfer belt 21 after the secondary transfer are charged to different polarities. Accordingly, a voltage of positive polarity is applied to the first cleaning portion 60 to attract negatively charged toner and the like, and a voltage of negative polarity is applied to the second cleaning portion 70 to attract positively charged toner and the like.

In the first cleaning portion 60, voltages of positive polarity that are different in magnitude are applied to the first fur brush 25 and the first reclaim roll 27. Specifically, a lower voltage is applied to the first fur brush 25 by a power supply 72 and a higher voltage is applied to the first reclaim roll 27 by a power supply 73. On the other hand, in the second cleaning portion 70, voltages of negative polarity that are different in magnitude are applied to the second fur brush 26 and the second reclaim roll 28. Specifically, a lower voltage is applied to the second fur brush 26 by a power supply 74 and a higher voltage is applied to the second reclaim roll 28 by a power supply 75.

As described above, by setting the voltages applied to the first reclaim roll 27 and the second reclaim roll 28 higher than the voltages applied to the first fur brush 25 and the second fur brush 26, toner particles reclaimed by the first fur brush 25 and the second fur brush 26 are moved to the first reclaim roll 27 and the second reclaim roll 28, respectively.

It should be noted that cleaning may be performed by use of a roll member such as a rubber roll configured with, for example, a material softer than that of the secondary transfer belt 21, in place of the first fur brush 25 and the second fur brush 26.

It should be noted that, in the exemplary embodiment, the controller 40 reverses the polarities of voltages applied to the first cleaning portion 60 and the second cleaning portion 70 every predetermined printing cycles. Usually, toner has either one of the polarities; if the toner is charged to the negative polarity in the developing device 14, the amount of negatively charged toner is larger than that of the positively charged toner. Therefore, most of the toner that is negatively charged is firstly removed in the first cleaning portion 60, and thereafter, the toner of relatively small amount that is positively charged is removed by the second cleaning portion 70. As a result, the amount of toner removed by the first cleaning portion 60 is larger than the amount of toner removed by the second cleaning portion 70. Accordingly, an increase rate of foreign material deposited in a reclaim box not shown in the figure is larger in the first cleaning portion 60 than in a reclaim box of the second cleaning portion 70.

In view of the above circumstances, in the exemplary embodiment, the polarities of voltages applied to the first cleaning portion 60 and the second cleaning portion 70 are mutually reversed every predetermined cycle. Thus, the amounts of reclaimed toner deposited in the two toner reclaim boxes are averaged to make effective use of each toner reclaim box.

Figure 3:
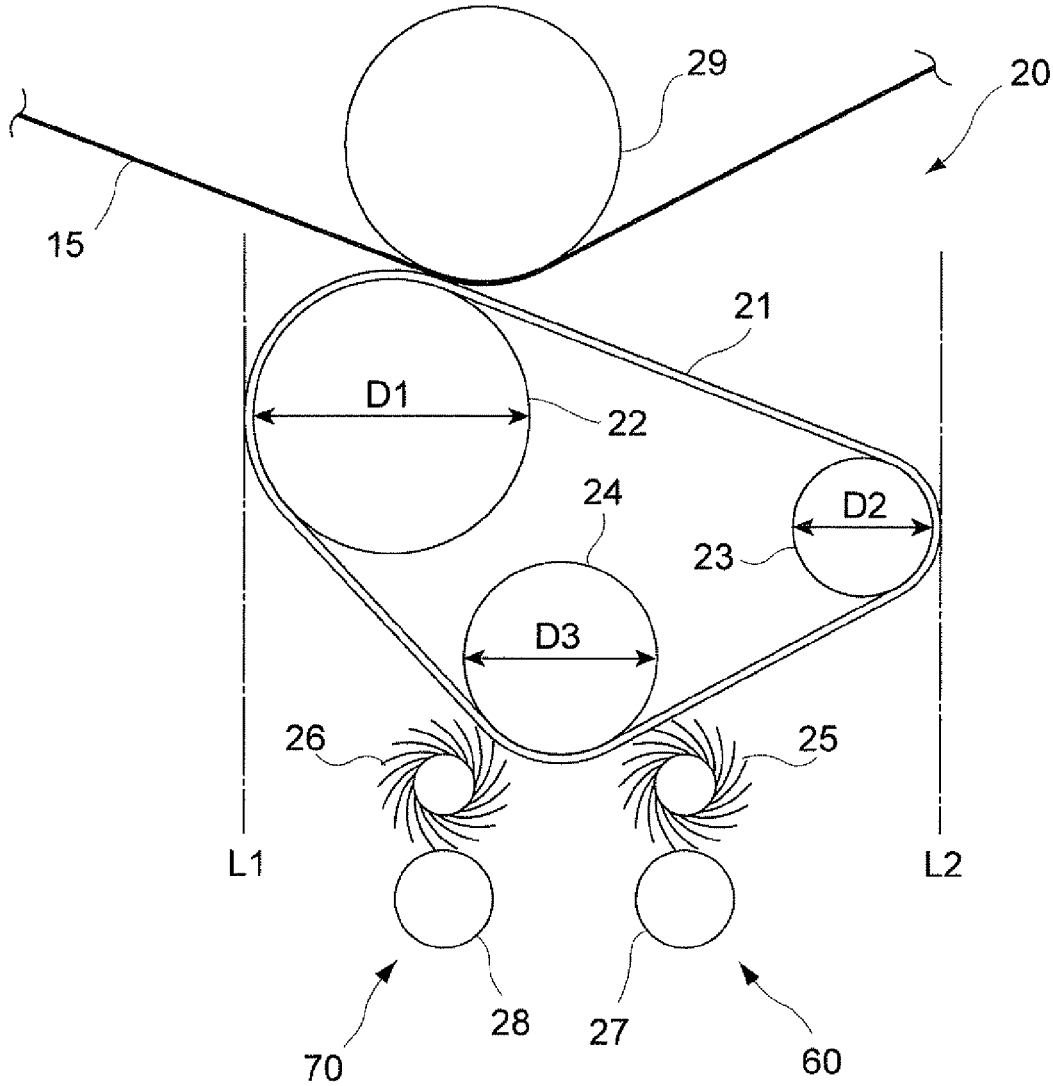
FIG. 3 illustrates placement or size of each member in the secondary transfer device.

FIG. 3 illustrates placement or size of each member in the secondary transfer device 20.

In the first place, in the secondary transfer device 20 of the exemplary embodiment, the diameter of the peeling roll 23 (hereinafter, referred to as peeling roll diameter D2) is set smaller than the diameter of the secondary transfer roll 22 (hereinafter, referred to as secondary transfer roll diameter D1), as shown in FIG. 3 (D2<D1).

To improve the transfer performance in the secondary transfer portion, the width in which the secondary transfer roll 22 faces the intermediate transfer belt 15 may be broader. Further, a voltage of, for example, equal to or more than about 2000 V is applied to the secondary transfer roll 22 when the secondary transfer is performed. Consequently, in view of deterioration of the secondary transfer roll 22 due to application of high voltage, the size of the secondary transfer roll 22 may be made larger. Accordingly, the secondary transfer roll diameter D1 may be relatively larger.

On the other hand, the peeling roll 23 serves as a member that peels off the sheet P from the secondary transfer belt 21. To facilitate peeling off the sheet P from the secondary transfer belt 21, the curvature of the secondary transfer belt 21 formed by the peeling roll 23 may be smaller. Accordingly, the peeling roll diameter D2 may be relatively smaller.

As described above, the secondary transfer roll diameter D1 is set larger and the peeling roll diameter D2 is set smaller, thereby enhancing the function exerted by each roll member. It should be noted that, in the case where the secondary transfer roll diameter D1 and the peeling roll diameter D2 coincide with each other, there is no difference between peeling off the sheet P by the peeling roll 23 and peeling off the sheet P by the secondary transfer roll 22; and therefore it is less significant to provide the peeling roll 23 separately in order to peel off the sheet P from the secondary transfer belt 21. Consequently, the peeling roll diameter D2 is set smaller than the secondary transfer roll diameter D1 in the secondary transfer device 20 of the exemplary embodiment.

Further, in the secondary transfer device 20 of the exemplary embodiment, as shown in FIG. 3, the diameter of the cleaner-facing roll 24 (hereinafter, referred to as cleaner-facing roll diameter D3) is set larger than the peeling roll diameter D2 (D3>D2).

In the exemplary embodiment, the cleaning device 90 is arranged to face the cleaner-facing roll 24. Therefore, the cleaner-facing roll diameter D3 is required to have a sufficient dimension such that the cleaning device 90 may face. Accordingly, the cleaner-facing roll diameter D3 may be larger. On the other hand, the peeling roll diameter D2 may be set smaller as described above.

As described above, the cleaner-facing roll diameter D3 is set larger and the peeling roll diameter D2 is set smaller, thereby enhancing the function exerted by each roll member. It should be noted that the roll diameter set to peel off the sheet P from the secondary transfer belt 21 does not ensure the sufficient dimension to be faced by the cleaning device 90. Consequently, the cleaner-facing roll diameter D3 is set larger than the peeling roll diameter D2 in the secondary transfer device 20 of the exemplary embodiment.

Next, description will be provided with regard to an angle of an arc formed by the secondary transfer belt 21 brought into contact with the outer peripheral surface of each roll member (hereinafter, referred to as a wrap angle).

In the exemplary embodiment, as shown in FIG. 3, three roll members are arranged to have a form analogous to equilateral triangle, and the secondary transfer belt 21 is mounted around these three roll members. Therefore, in the secondary transfer device 20 of the exemplary embodiment, the wrap angle of the secondary transfer belt 21 with respect to each of the secondary transfer roll 22, the peeling roll 23 and the cleaner-facing roll 24 is about 120 degrees. In the exemplary embodiment, the wrap angle with respect to each roll member is averaged, thereby causing the wrap angle to be shallow in each of the roll members.

Further, as shown in FIG. 3, in the secondary transfer device 20 to which the exemplary embodiment is applied, the first fur brush 25 and the second fur brush 26 of the cleaning device 90 are arranged within a space between a virtual line segment L1 and a virtual line segment L2. The virtual line segment L1 extends vertically downward from an upstream side end portion of a belt surface in the rotation direction of the secondary transfer belt 21, and the virtual line segment L2 extends vertically downward from a downstream side end portion of the belt surface in the rotation direction of the secondary transfer belt 21. The belt surface is formed between the secondary transfer roll 22 and the peeling roll 23.

The paper debris brought by the sheet P entered into the secondary transfer portion falls downwardly (along the virtual line segment L1) from an upstream side end portion of the secondary transfer roll 22 in the rotation direction of the secondary transfer belt 21. Also, at a downstream side end portion of the peeling roll 23 in the rotation direction of the secondary transfer belt 21, the paper debris attached to the sheet P easily flies off. In this case, the paper debris falls downwardly (along the virtual line segment L2) from the downstream side end portion of the peeling roll 23.

In the secondary transfer device 20 of the exemplary embodiment, the first fur brush 25 and the second fur brush 26 are arranged within the virtual line segment L1 and the virtual line segment L2, thus preventing intrusion of the paper debris from a location other than the surface of the secondary transfer belt 21 into the first fur brush 25 and the second fur brush 26 to suppress degradation in cleaning performance.

The operations of the image forming apparatus 1 including the secondary transfer device 20 as configured above will be described.

Image data outputted from an image reader, a personal computer (PC) or the like not shown in the figure is inputted to the controller 40 of the image forming apparatus 1. The controller 40 performs image processing on the obtained image data. Then the controller 40 operates the image forming units 10 or the like to execute image forming operations based on the obtained image data. Specifically, the controller 40 performs image processing such as shading correction, misregistration correction, lightness/color space conversion, gamma correction, frame erase, color editing and movement editing on the inputted reflectance data. The controller 40 converts the image data subjected to the image processing into coloring material gradation data of four color components of yellow (Y), magenta (M), cyan (C) and black (K), and outputs the coloring material gradation data to the laser exposure device 13.

In accordance with the inputted coloring material gradation data, the laser exposure device 13 irradiates the photoconductive drum 11 in each of the image forming units 10Y, 10M, 10C and 10K with an exposure beam Bm emitted by, for example, a semiconductor laser. The surface of the photoconductive drum 11 in each of the image forming units 10Y, 10M, 10C and 10K is charged by the charging device 12, and thereafter, exposed and scanned by the laser exposure device 13 to form the electrostatic latent image. The developing device 14 develops the electrostatic latent image in each of the image forming units 10Y, 10M, 10C and 10K, thereby forming the toner image of each of colors of yellow (Y), magenta (M), cyan (C) and black (K), respectively.

The toner image formed on the photoconductive drum 11 in each of the image forming units 10Y, 10M, 10C and 10K is transferred onto the intermediate transfer belt 15 at the primary transfer portion where each photoconductive drum 11 and the intermediate transfer belt 15 face with each other. More specifically, at the primary transfer portion, the primary transfer roll 16 applies a voltage of a polarity opposite to the charging polarity of the toner to the base material of the intermediate transfer belt 15. Then the unfixed toner images of respective colors are successively superimposed on the surface of the intermediate transfer belt 15. The unfixed toner images primarily transferred in this manner are transported to the secondary transfer device 20 with the rotation of the intermediate transfer belt 15.

On the other hand, in the sheet transport system, the pickup roll 51 is rotated with the timing of image formation to supply the sheet P of a predetermined size from the sheet container 50. The sheet P supplied by the pickup roll 51 is transported by the transport rolls 52 and arrives at the secondary transfer device 20 via the transport route 53. Then the sheet P is once stopped, and a registration roll (not shown in the figure) is rotated with the moving timing of the intermediate transfer belt 15 on which the toner images are carried, thus performing registration between the position of the sheet P and the position of the toner image.

The sheet P transported in timing is inserted into the secondary transfer portion formed between the intermediate transfer belt 15 and the secondary transfer belt 21. On that occasion, the power feeding roll 29A generates the transfer electric field by applying a voltage having the same polarity with the charging polarity of the toner. In the secondary transfer portion formed by the secondary transfer roll 22 and the backup roll 29, the unfixed toner image carried on the intermediate transfer belt 15 is electrostatically transferred onto the sheet P by the generated transfer electric field.

Thereafter, the sheet P on which the toner image has been electrostatically transferred is transported to the downstream side in the process direction by the secondary transfer belt 21. When the sheet P arrives at the position of the peeling roll 23, the sheet P is peeled from the secondary transfer belt 21. Then the sheet P is transported to the transport belt 54 provided on the downstream side in the transport direction at a constant speed. The sheet P having been transported to the trail edge of the transport belt 54 is moved to the transport belt 55 via the guide route 56. On the transport belt 55, the sheet P is transported to the fixing device 30 while changing the transport speed in accordance with the fixing process performed in the fixing device 30. The fixing device 30 performs the fixing process with heat and pressure so that the unfixed toner image on the sheet P is fixed on the sheet P. Then the sheet P on which the fixed image is formed is discharged to the outside of the apparatus by an exit roll (not shown in the figure). On the other hand, after the transfer of the toner image onto the sheet P is finished, the belt cleaner 41 removes the residual toner remaining on the intermediate transfer belt 15.

Next, description will be provided with regard to test runs using the secondary transfer device 20 to which the above-described exemplary embodiment is applied (example) and a secondary transfer device 120 as a comparative example.

Figure 4:
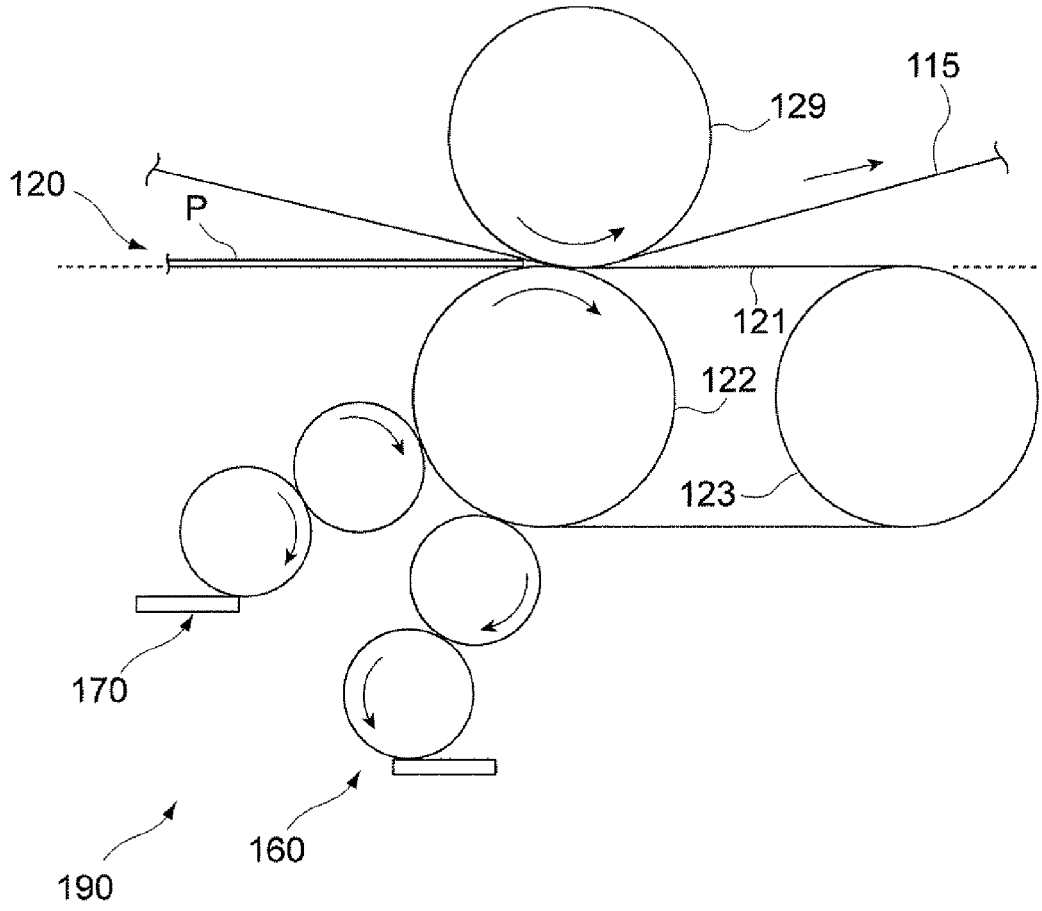
FIG. 4 is an overall view of a secondary transfer device as a comparative example.

FIG. 4 is the overall view of the secondary transfer device 120 as the comparative example.

In the secondary transfer device 120 of the comparative example, a belt is mounted around two roll members. Specifically, the secondary transfer device 120 includes a secondary transfer belt 121, a drive roll 122 that drives the secondary transfer belt 121 and a follower roll 123, around which and the drive roll 122 the secondary transfer belt 121 is mounted. The drive roll 122 is grounded. The drive roll 122 functions as a counter electrode for generating the secondary transfer electric field when the secondary transfer is performed, and also functions as a counter electrode for generating the cleaning electric field in a first cleaning portion 160 and a second cleaning portion 170. It should be noted that, in the secondary transfer device 120 of the comparative example, a volume resistance of the drive roll 122 is set to about $10^{5.8}\Omega$ (about 5.8 log Ω).

An intermediate transfer belt 115 and a backup roll 129 in the comparative example are similar to the intermediate transfer belt 15 and the backup roll 29 in the example, respectively. Further, the material of the secondary transfer belt 121 in the comparative example is similar to that of the secondary transfer belt 21 in the example. Moreover, a cleaning device 190 (the first cleaning portion 160 and the second cleaning portion 170) in the comparative example is similar to that of the example in the basic structure.

The test runs for 500000 prints are conducted in an image forming apparatus having the secondary transfer device 120 as configured above of the comparative example and the image forming apparatus having the secondary transfer device 20 of the example. Two settings ate provided as environmental conditions for the test: an assumed environment of a normal state where the temperature is about 22° C. and the humidity is about 55%; and an assumed environment of high temperature and high humidity where the temperature is about 28° C. and the humidity is about 85%, and the test is conducted for each environment.

As a result, in the image forming apparatus of the comparative example, there occurs a so-called deletion, in which a part of a toner image is not secondarily transferred or scattering of the toner in the secondary transfer. Especially, under the environment of high temperature and high humidity, the deletion or scattering of the toner noticeably occurs. After the test is finished, the secondary transfer belt 121 in the secondary transfer device 120 of the comparative example is observed and it is found that distortion is formed by the drive roll 122 and the follower roll 123 (hereinafter, referred to as wrap distortion). The wrap distortion in the secondary transfer belt 121 noticeably appears in the case of the test runs under the environment of high temperature and high humidity.

On the other hand, in the secondary transfer device 20 of the example, neither deletion nor scattering of the toner occurs. Further, no wrap distortion is found in the observation of the secondary transfer belt 21 in the secondary transfer device 20 of the example.

Figure 5A:
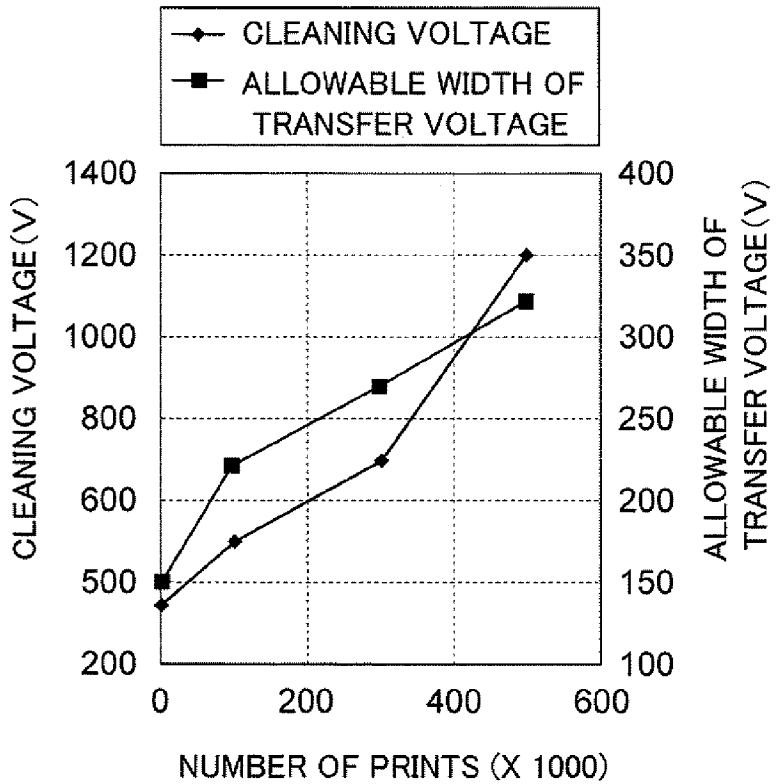
FIGS. 5A and 5B illustrate a relation between a number of prints and a cleaning voltage and a relation between a number of prints and a secondary transfer voltage.
Figure 5B:
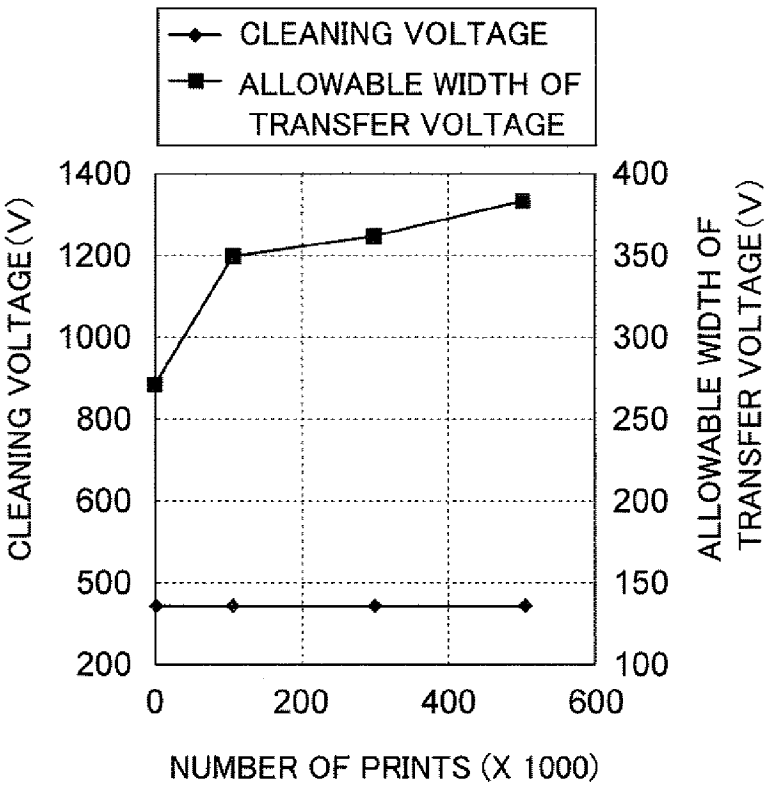

FIGS. 5A and 5B illustrate a relation between the number of prints and the cleaning voltage, and a relation between the number of prints and an allowable width of the secondary transfer voltage. FIG. 5A shows a state of the secondary transfer device 120 of the comparative example. FIG. 5B shows a state of the secondary transfer device 20 of the example.

A horizontal axis in each of the graphs shown in FIGS. 5A and 5B indicates the number of prints. A vertical axis on the left side of each graph indicates the cleaning voltage value applied to generate the cleaning electric field. Another vertical axis on the right side of each graph indicates a width of the range of an applied voltage value that satisfies both secondary transfer voltage value for secondarily transferring the toner image of only black color in forming a monochrome image and a secondary transfer voltage value for secondarily transferring the multicolor toner image in forming a color image (hereinafter, referred to as an allowable width of the transfer voltage).

For example, in the case where the secondary transfer voltage necessary to form a monochrome image is from about 800 to about 1200 V and the secondary transfer voltage necessary to form a color image is from about 1100 to about 1500 V, the range of the applied voltage value that satisfies both is from about 1100 to about 1200 V. In this case, the allowable width of the transfer voltage is about 100 V.

As the allowable width of the transfer voltage is larger, it becomes unlikelier that the actually set secondary transfer voltage deviates from the secondary transfer voltage to be applied at the secondary transfer portion, and thereby secondary transfer may be performed with stability. Conversely, as the allowable width of the transfer voltage is smaller, it becomes likelier that actually set secondary transfer voltage deviates from the secondary transfer voltage to be applied at the secondary transfer portion.

As shown in FIG. 5A, in the secondary transfer device 120 of the comparative example, the initial allowable width of the transfer voltage is, for example, about 150 V. Also, as shown in FIG. 5A, the allowable width of the transfer voltage becomes larger as the number of prints increases. At the time point when the number of prints reaches 500000, the allowable width of the transfer voltage exceeds about 300 V. In this manner, in the secondary transfer device 120 of the comparative example, the allowable width of the transfer voltage reaches the level that the applied voltage in the secondary transfer portion may be easily set (for example, about 250 V) after the number of prints becomes a considerable number.

Further, the cleaning voltage gradually becomes higher as the number of prints increases. For example, the cleaning voltage at an initial stage is about 350 V, but becomes about 1200 V when the number of prints reaches 500000. Since the drive roll 122 of the comparative example is a resistive body having a volume resistance of about $10^{5.8}\Omega$ (about 5.8 log Ω) and also functions as the counter electrode to generate the secondary transfer electric field, a high voltage (for example, from about 2000 to about 5000 V) is applied when the secondary transfer is performed. Consequently, in the drive roll 122, increase of the volume resistance with time is noticeable. In the secondary transfer device 120 of the comparative example, at the time point when the number of prints reaches 500000, the volume resistance of the drive roll 122 comes to about $10^{7.5}\Omega$ (about 7.5 log Ω). The cleaning voltage for generating the cleaning electric field reaches about 1200 V, which is an upper limit of the capacity of a power supply for the cleaning device 190.

On the other hand, as shown in FIG. 5B, in the secondary transfer device 20 of the example, the allowable width of the transfer voltage is relatively large compared to the initial state. The allowable width of the transfer voltage may keep a state of being relatively large (in this example, a state exceeding about 250 V) even though the number of prints reaches 500000. The cleaning voltage is, while being about 350 V initially, also about 350 V even at the time point when the number of prints reaches 500000; accordingly, the cleaning voltage hardly rises in spite of the increase of the number of prints.

To improve the transfer performance, the volume resistance of the roll member that generates the secondary transfer electric field in the secondary transfer portion may be set in the direction to increase. On the other hand, to improve the cleaning performance, the volume resistance of the roll member that generates the cleaning electric field may be set lower, or the roll member may be configured with a conductive roll member such as made of metal, in order to prevent rising of the cleaning voltage with time, for example.

In the secondary transfer device 20 to which the exemplary embodiment is applied, the secondary transfer belt 21 is mounted around three roll members; the secondary transfer roll 22, the peeling roll 23 and the cleaner-facing roll 24. Different functions are assigned to those respective roll members. Consequently, in the secondary transfer device 20 in the exemplary embodiment, both improvement of the transfer performance and improvement of the cleaning performance may be sought.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms a toner image;

an image carrier that carries the toner image formed by the image forming unit;

a transfer belt that is endless and rotates with a recording medium interposed between the transfer belt and the image carrier;

a cleaner that is provided to be in contact with an outer surface of the transfer belt and electrostatically cleans toner adhering to the outer surface of the transfer belt;

a transfer roll that is provided inside the transfer belt and generates a transfer electric field between the transfer roll and the image carrier for transferring the toner image from the image carrier to the recording medium while pressing the transfer belt toward the image carrier;

a cleaning roll which is mounted proximate to the transfer belt as well as the transfer roll, the cleaning roll being provided to face the cleaner; and a tension roll which is mounted proximate to the transfer belt as well as the transfer roll and the cleaning roll, wherein a diameter of the cleaning roll is larger than a diameter of the tension roll.

2. The image forming apparatus according to claim 1, wherein the tension roll is provided downstream of the transfer roll in a rotation direction of the transfer belt, and a diameter of the tension roll is smaller than a diameter of the transfer roll.

3. An image forming apparatus comprising:

an image forming unit that forms a toner image;

an image carrier that carries the toner image formed by the image forming unit;

a transfer belt that is endless and rotates with a recording medium interposed between the transfer belt and the image carrier;

a cleaner that is provided to be in contact with an outer surface of the transfer belt and electrostatically cleans toner adhering to the outer surface of the transfer belt;

a transfer roll that is provided inside the transfer belt and generates a transfer electric field between the transfer roll and the image carrier for transferring the toner image from the image carrier to the recording medium while pressing the transfer belt toward the image carrier;

a cleaning roll which is mounted proximate to the transfer belt as well as the transfer roll, the cleaning roll being provided to face the cleaner; and a tension roll which is mounted proximate to the transfer belt as well as the transfer roll and the cleaning roll, wherein a diameter of the cleaning roll is larger than a diameter of the tension roll, the cleaner includes a first cleaning member and a second cleaning member, to which voltages of mutually different polarities are applied, each of the first cleaning member and the second cleaning member cleaning the transfer belt, the first cleaning member is provided in contact with a surface of the transfer belt between the cleaning roll and the transfer roll, and the second cleaning member is provided in contact with a surface of the transfer belt between the cleaning roll and the tension roll.

4. The image forming apparatus according to claim 3, wherein the tension roll is provided downstream of the transfer roll in a rotation direction of the transfer belt, and a diameter of the tension roll is smaller than a diameter of the transfer roll.

5. An image forming apparatus comprising:

an image forming unit that forms a toner image;

an image carrier that carries the toner image formed by the image forming unit;

a transfer belt that is endless and rotates with a recording medium interposed between the transfer belt and the image carrier;

a cleaner that is provided to be in contact with an outer surface of the transfer belt and electrostatically cleans toner adhering to the outer surface of the transfer belt;

a transfer roll that is provided inside the transfer belt and generates a transfer electric field between the transfer roll and the image carrier for transferring the toner image from the image carrier to the recording medium while pressing the transfer belt toward the image carrier;

a cleaning roll which is mounted proximate to the transfer belt as well as the transfer roll, the cleaning roll being provided to face the cleaner; and a tension roll which is mounted proximate to the transfer belt as well as the transfer roll and the cleaning roll, wherein a diameter of the cleaning roll is larger than a diameter of the tension roll, the cleaner includes a first cleaning member and a second cleaning member, to which voltages of mutually different polarities are applied, each of the first cleaning member and the second cleaning member cleaning the transfer belt, the first cleaning member is provided in contact with a surface of the transfer belt between the cleaning roll and the transfer roll, the second cleaning member is provided in contact with a surface of the transfer belt between the cleaning roll and the tension roll, the first cleaning member and the second cleaning member in the cleaner are positioned in a region between a first virtual line segment and a second virtual line segment, the first virtual line segment extending vertically downward from an upstream side end portion of a belt surface in a moving direction of the transfer belt, the second virtual line segment extending vertically downward from a downstream side end portion of the belt surface in the moving direction of the transfer belt, and the belt surface being provided between the transfer roll and the tension roll.

6. The image forming apparatus according to claim 5, wherein the tension roll is provided downstream of the transfer roll in a rotation direction of the transfer belt, and a diameter of the tension roll is smaller than a diameter of the transfer roll.

7. An image forming apparatus comprising:

an image forming unit that forms a toner image;

an image carrier that carries the toner image formed by the image forming unit;

a transfer belt that is endless and rotates with a recording medium interposed between the transfer belt and the image carrier;

a cleaner that is provided to be in contact with an outer surface of the transfer belt and electrostatically cleans toner adhering to the outer surface of the transfer belt;

a transfer roll that is provided inside the transfer belt and generates a transfer electric field between the transfer roll and the image carrier for transferring the toner image from the image carrier to the recording medium while pressing the transfer belt toward the image carrier;

a cleaning roll which is mounted proximate to the transfer belt as well as the transfer roll, the cleaning roll being provided to face the cleaner and generating a cleaning electric field between the cleaning roll and the cleaner; and a tension roll which is mounted proximate to the transfer belt as well as the transfer roll and the cleaning roll, wherein the tension roll is provided downstream of the transfer roll in a rotation direction of the transfer belt, a diameter of the tension roll is smaller than a diameter of the transfer roll, and a diameter of the cleaning roll is larger than the diameter of the tension roll.

8. The image forming apparatus according to claim 7, wherein the cleaner includes a first cleaning member and a second cleaning member, to which voltages of mutually different polarities are applied, each of the first cleaning member and the second cleaning member cleaning the transfer belt, the first cleaning member is provided in contact with a surface of the transfer belt between the cleaning roll and the transfer roll, and the second cleaning member is provided in contact with a surface of the transfer belt between the cleaning roll and the tension roll.

9. The image forming apparatus according to claim 8, wherein the first cleaning member and the second cleaning member in the cleaner are positioned in a region between a first virtual line segment and a second virtual line segment, the first virtual line segment extending vertically downward from an upstream side end portion of a belt surface in a moving direction of the transfer belt, the second virtual line segment extending vertically downward from a downstream side end portion of the belt surface in the moving direction of the transfer belt, and the belt surface being provided between the transfer roll and the tension roll.

10. A belt transport device comprising:

a transfer belt that is endless and rotates with a recording medium interposed between the transfer belt and an image carrier when the transfer belt is attached to an image forming apparatus including an image forming unit and the image carrier that carries a toner image formed by the image forming unit;

a cleaner that is provided to be in contact with an outer surface of the transfer belt and electrostatically cleans toner adhering to the outer surface of the transfer belt;

a transfer roll that is provided inside the transfer belt and generates a transfer electric field between the transfer roll and the image carrier of the image forming apparatus for transferring the toner image from the image carrier to the recording medium;

a cleaning roll which is mounted proximate to the transfer belt as well as the transfer roll, the cleaning roll being provided to face the cleaner and generating a cleaning electric field between the cleaning roll and the cleaner; and a tension roll which is mounted proximate to the transfer belt as well as the transfer roll and the cleaning roll, wherein the tension roll is provided downstream of the transfer roll in a rotation direction of the transfer belt, a diameter of the tension roll is smaller than a diameter of the transfer roll, and a diameter of the cleaning roll is larger than the diameter of the tension roll.

* * * * *